US006805607B2

(12) United States Patent
Hidalgo

(10) Patent No.: US 6,805,607 B2
(45) Date of Patent: Oct. 19, 2004

(54) SCENTED DOLL WITH THE APPEARANCE OF AN AGED PERSON

(76) Inventor: Ethel Hidalgo, 5650 Aspen Ridge Cir., Delray Beach, FL (US) 33484

( * ) Notice: Subject to any disclaimer, the term of this patent is extended or adjusted under 35 U.S.C. 154(b) by 14 days.

(21) Appl. No.: 10/161,945

(22) Filed: Jun. 4, 2002

(65) Prior Publication Data

US 2003/0224692 A1 Dec. 4, 2003

(51) Int. Cl.[7] ..... A63H 3/02
(52) U.S. Cl. ..... 446/369; 446/372
(58) Field of Search ..... 446/369–372, 446/100, 385, 183, 268

(56) References Cited

U.S. PATENT DOCUMENTS

| | | | | | |
|---|---|---|---|---|---|
| 800,333 | A | * | 9/1905 | Smith | 446/370 |
| 3,567,119 | A | | 3/1971 | Wilbert | |
| 3,820,276 | A | | 6/1974 | Goldfarb et al. | |
| 3,866,350 | A | * | 2/1975 | Goldfarb et al. | 446/383 |
| 3,977,121 | A | * | 8/1976 | Goldfarb et al. | 446/369 |
| 4,095,031 | A | | 6/1978 | Engle | |
| 4,341,036 | A | * | 7/1982 | Yeu | 446/385 |
| 4,648,851 | A | * | 3/1987 | Rosenberg | 446/372 |
| 4,884,991 | A | * | 12/1989 | Terzian | 446/369 |
| 4,889,284 | A | * | 12/1989 | Spector | 239/34 |
| 4,950,542 | A | | 8/1990 | Barker | |
| 4,964,831 | A | * | 10/1990 | Wolff | 446/75 |
| 5,037,343 | A | | 8/1991 | Benites | |
| 5,282,766 | A | * | 2/1994 | Fleet | 446/72 |
| 5,304,087 | A | * | 4/1994 | Terzian et al. | 446/340 |
| 5,676,583 | A | | 10/1997 | Wang et al. | |
| 5,823,432 | A | | 10/1998 | Hogan | |
| 5,947,791 | A | * | 9/1999 | Taylor | 446/321 |
| 6,012,963 | A | | 1/2000 | Lee | |
| 6,089,947 | A | | 7/2000 | Green | |
| 6,240,879 | B1 | * | 6/2001 | Denesuk et al. | 119/709 |
| 6,264,526 | B1 | * | 7/2001 | Meeker | 446/369 |
| 6,357,260 | B1 | | 3/2002 | Lutz | |

OTHER PUBLICATIONS

Caroline Goodfellow, Ultimate Doll Book, MetroBooks, New York, 1993, pp. 88–91.

* cited by examiner

*Primary Examiner*—Jacob K. Ackun
*Assistant Examiner*—Faye Francis
(74) *Attorney, Agent, or Firm*—Ronald V. Davidge

(57) ABSTRACT

A doll having a cloth body stuffed with pellets coated with fragrant oil has external features emulating the appearance of an aged person. These features include folds, emulating wrinkled skin, in a flexible covering extending over the head and face of the doll. The flexible covering is gathered into folds and stretched for attachment to a torso portion of the body at a narrowed neck, and folds also extend from lip and nose features of the doll face.

13 Claims, 2 Drawing Sheets

SCENTED DOLL WITH THE APPEARANCE OF AN AGED PERSON

BACKGROUND OF THE INVENTION

1. Field of the Invention

This invention relates to dolls, and, more particularly, to an internally scented doll having the outward appearance of an aged person.

2. Summary of the Background Art

The fabrication and use of many types of dolls are well known in the art, dating from antiquity. Many dolls have been designed to enhance their play value for children, most recently through articulation allowing the doll to be placed in a number of posed positions by a child and through the use of mechanical and electronic devices mimicking human activities, such as speech and eating. Other dolls have been designed to enhance their value as collectables by forming detailed and realistic likenesses of famous real or fictional people or stereotypes. Most commercially available dolls are produced for children, representing stereotypes of types of people they would like to become, such as a doctor, a gymnast, or an airline stewardess, or babies and young children, with which the user can emulate parenting. What is needed is a doll that provides a concrete representation of the concept that true beauty comes from inside a person instead of from his external appearance.

The commercial production of cloth dolls began in the 1850's in the United States and England, and continues through present times. A particularly significant cloth doll was the Columbian Doll, which, having been introduced at the Chicago Worlds Fair in 1893, was produced until 1910. Cloth doll bodies are usually made of calico, a coarse, usually unbleached cotton fabric, or of muslin, a fine, plain-weave cotton fabric, being stuffed with materials such as cotton, cloth, or sawdust. The tactile feel of a cloth doll, and the manner in which it is articulated, are determined largely by the way the body is sewn and the material with which it is filled. Seams sewn into the cloth sleeve forming the body at the joints provide for articulation.

U.S. Pat. No. 3,820,276 describes a sort, formable, pellet-filled doll, which may be played with either as an ordinary doll or as a hand puppet. The doll includes a flexible casing portion having an upper torso portion, a lower torso portion, and a pair of leg portions. The casing contains a body of shiftable filler, such as discrete plastic pellets, which help give form and shape to the doll in various positions, such as sitting. A head and a pair of arms are secured to the upper torso portion. A flexible cover sheet of material is disposed over the back of the upper torso to define an exterior compartment for receiving the hand of the user when the doll is being used as a hand puppet. To facilitate multiple usage, the doll is constructed and arranged so that the pellets can flow out of the upper torso portion when the doll is being used as a hand puppet, to thereby maintain reasonable proportioning between the upper portion and the body, which is then enlarged by the hand of the user, and the remainder of the doll. On the other hand, when the user's hand is removed, the pellets may be caused to flow into and occupy the upper torso portion to give the doll a full, three dimensional lifelike appearance and feel. In this connection, the doll may be arranged in an upright sitting position where the legs are virtually emptied of the pellets, and a great majority of the pellets are concentrated within the torso portion.

U.S. Pat. Nos. 5,676,583 and 6,012,963 describe perfumed or scented dolls. Of these, U.S. Pat. No. 5,676,583 describes a perfumed doll including an inner tubular member that is screwed into an outer tubular member extending within the body of the doll and holding an upward-extending wick. The bottom of the inner tubular member extends outward, allowing its removable for refilling with perfume, which is then evaporated through the wick. Alternately, a solid fragrant substance is used without the wick. U.S. Pat. No. 6,012,963 describes a system of colored, scented dolls, each of which is constructed from a molded vinyl mixed with a coloring substance and a scenting substance. The vinyl is molded in a human form, with the coloring substance and the scenting substance being combined in a combination selected from a group including red and cherry, orange and orange, yellow and lemon, and purple and grape.

Other patents describe air fresheners for hanging within a room or within an automobile. For example, U.S. Pat. No. 6,089,947 describes an air freshener representing an animal, cartoon character, or other figure, into which at least one scent-releasing capsule is inserted through a mouth formed within a body of the figure. The scent-releasing capsule releases scent through an air permeable body. Additional fresh capsules can be inserted through the mouth and retained by the body member. U.S. Pat. No. describes an air freshener in which an insert provides shape to an article of clothing so that the air freshener device assumes the shape of the article of clothing. The air freshener device also includes a pouch formed in the article of clothing to receive scented beads or other aromatic material.

Other patents describe articles including scented elements that can be worn by the user. For example, U.S. Pat. No. 6,357,260 describes a scented friendship bracelet kit containing several ornamental beads, a plurality of polymer pellets impregnated with a fragrance, a mesh fabric bundled about the beads and pellets, and a tie string holding the fabric bundle, with the kit being provided as a bundle that can also be used as an air freshener. U.S. Pat. No. 4,465,232 describes an adornment having a front face, preferably decorated, and a rear face, which preferably has an adhesive layer for fixing the adornment to another surface, such as the body, an article of clothing, or a package. The front face also has a pocket for receiving a scented element, which is preferably a scent-saturated pellet or a scent-filled capsule.

U.S. Pat. No. 5,037,343 describes a skunk-like figure having a tail member including a cavity, with a matrix of slits directing an aromatic scent selectively from microcapsules containing a scented liquid within the cavity.

Yet other patents describe methods for making aromatic materials and for coating articles with aromatic liquids so that an aroma is released from the materials over a long period of time. For example, U.S. Pat. No. 3,567,115 describes improved methods for incorporating fragrance compounds or oil bouquets and other agents into polymeric or natural materials so that the fabricated product possesses the properties imparted by the additive(s) for a long period of time. U.S. Pat. No. 4,095,031 describes perfumed composites of ethylene and polar monomer copolymers, such as vinyl acetate and ethyl acrylate. Shaped bodies prepared from such composites faithfully retain the fragrance of the perfume oil for periods up to a year and more. U.S. Pat. No. 4,950,542 describes methods for coating articles with a composition of a homogeneous emulsion of polyurethane and essential oils to provide a sustained release of an aroma.

SUMMARY OF THE INVENTION

It is a first objective of the invention to provide a doll in the form of a concrete representation of a concept that true beauty originates not in the external appearance of a person, but rather radiates from internal characteristics of the person.

It is another objective of the invention to provide a doll having an aged outward appearance.

It is yet another objective of the invention to provide a doll having internal elements emitting a fragrance.

It is a further objective of the invention to provide a doll having a soft cloth body filled with a material providing a physical structure and an emitted fragrance.

In accordance with an aspect of the invention a doll is provided including a permeable body covering; external features emulating an appearance of an aged person; and an internal structure within said body covering emitting a perfume fragrance through said permeable body covering. Permeability is required to allow the fragrance to escape. Preferably, the permeable body covering is composed of a cloth material, and internal structure includes a number of pellets, coated with fragrant oil, stuffing and shaping the body covering.

Preferably, the doll also includes a head portion having a core, over which a flexible cover is stretched, with the body covering including a torso portion, a pair of arm portions, and a pair of leg portions. Such a flexible cover includes a lower portion stretched and gathered together to form a narrowed neck attached to the torso portion. The core preferably includes contoured features forming facial features in the flexible cover to emulate the features of a person as the flexible cover is pulled over the core. The doll additional includes an elongated member, such as a stick, extending through the narrowed neck between the core and the torso portion. Thus, the external features emulating an appearance of an aged person include folds formed within the lower portion of the flexible cover and folds in the flexible cover extending from the facial features in the flexible cover.

DETAILED DESCRIPTION OF THE INVENTION

Figure 1:
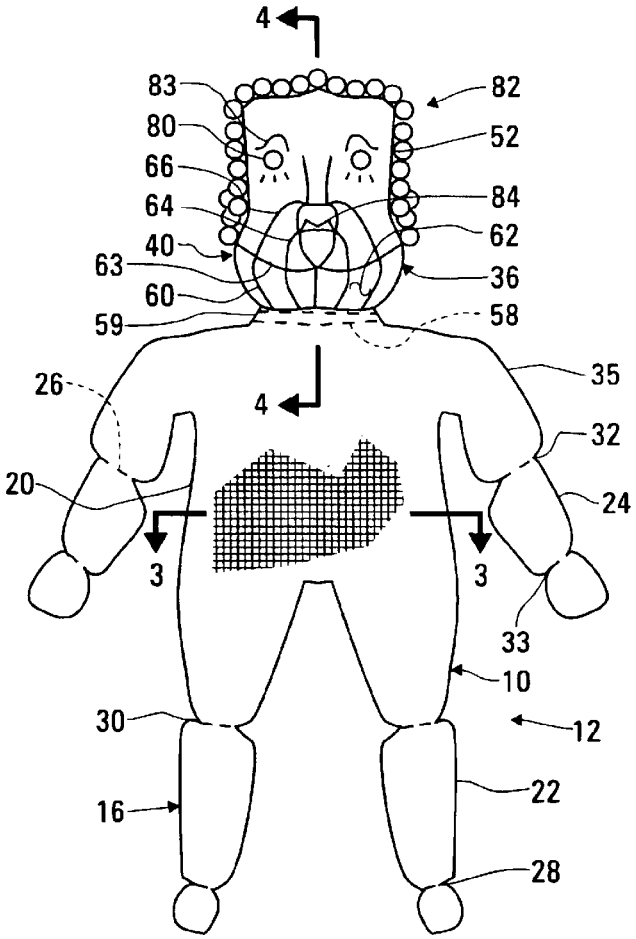
FIG. 1 is a front elevation of a body of a doll made in accordance with the present invention.
Figure 2:
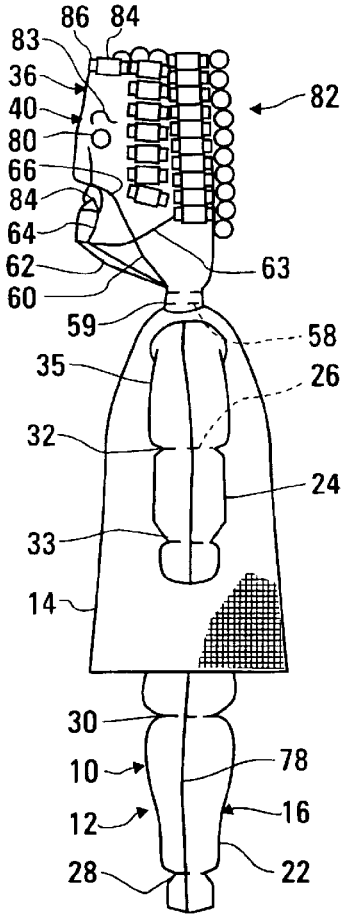
FIG. 2 is a left elevation of the doll of FIG. 1 with clothing in place.
Figure 3:
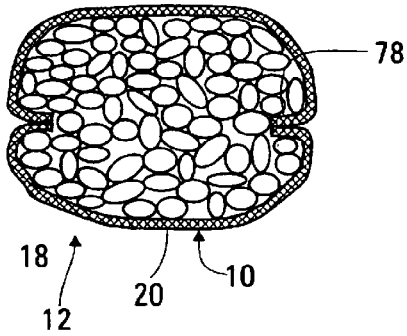
FIG. 3 is a transverse cross-sectional view of the doll body of FIG. 1, taken as indicated by section lines 3—3 therein.

FIG. 1 is a front elevation of a body 10 of a doll 12 made in accordance with the invention, and FIG. 2 is a left elevation of the doll 12 with clothing 14 in place. FIG. 3 is a transverse cross-sectional view taken through the doll body 10 as indicated by section lines 3—3 in FIG. 1.

The doll body 10 includes a muslin body cover 16 filled with a number of discrete pellets 18 coated with a perfume or fragrant oil. The muslin body cover 16 is sewn to form a closed structure holding the pellets 18, including a torso portion 20, a pair of leg portions 22, and a pair of arm portions 24. Articulation of the leg portions 22 and the arm portions 24 is provided by seams 26 closing the structure at the ankles 28, knees 30, elbows 32, and wrists 33 to such as extent that pellets 18 cannot move past the seams 26. On the other hand, the cavities within the upper leg portions 34 and the upper arm portions 35 are preferably in communication with the torso portion 20, allowing pellets 18 to flow therebetween. This construction has an advantage over prior art methods in that the pellets 18 function both as a stuffing material, filling cavities within the body cover 16 and giving it form and shape, and as a source of the fragrance.

Figure 4:
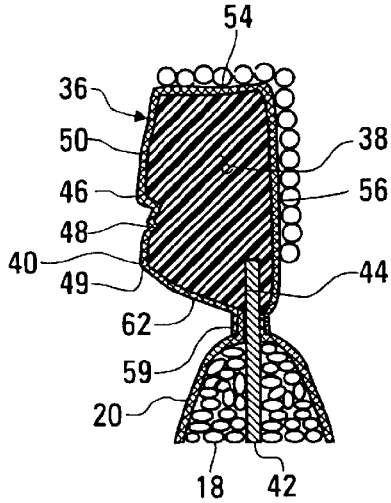
FIG. 4 is a fragmentary vertical cross-sectional view of the doll body of FIG. 1, taken as indicated by section lines 4—4 therein to reveal the internal construction of a head portion thereof.

FIG. 4 is a vertical cross sectional elevation through a head portion 36 of the doll 12, taken as indicated by section lines 4—4 in FIG. 1. Referring to FIGS. 1 and 4, the head portion 36 preferably includes a core 38 composed of a light plastic material, such as a foamed polystyrene resin, covered by a muslin head cover 40. The core 38 is held in place by means of a stick 42 extending from a slot 44 within the core 38 into the pellets 18 within the torso portion 20. The core 38 imparts its general shape to the shape of the head portion 36, with shaped features of the core 38, such as a nose feature 46, a lips feature 48, and chin feature 49, imparting similar shapes to the head portion 36 as the muslin head cover as the muslin cover 40 is stretched across the face 50 and along the sides 52 of the head portion 36, to be fastened together with a seam (not shown) extending along the top 54 of the head portion 36 and along the back 56 of the head portion 36.

The muslin head cover 40 is sewn to the muslin body cover 16 at a neck seam 58. Preferably, an appearance of an aged person is imparted to the doll 10 by holding the muslin head cover 40 pulled downward from the chin portion 49 of the core 38, and gathered together by attachment at the neck seam 58, forming a number of folds 60 in a neck portion 62 of the muslin head cover 40. This gathering arises from the fact that the stick 42 around which the neck portion is sewn is much smaller in cross sectional area than the core 38 extending above the neck portion 62. Preferably, additional folds extend from other shaped features of the core 38, with folds 64 extending from ends of the lips portion 48, and with folds 66 extending from the lower edge of the nose portion 46.

Figure 5:
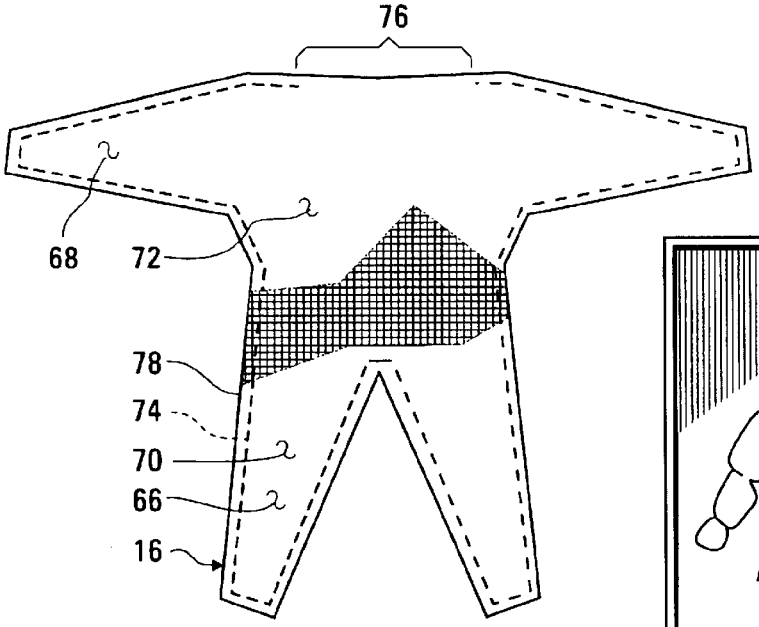
FIG. 5 is a front elevation of a cloth structure used within the doll body of FIG. 1.

FIG. 5 is a front view of the muslin body cover 16 before it is filled with the pellets 18. The process of making the doll 12 begins with cutting an identical pair of cover sections 66 from a sheet of muslin cloth. Alternately, the arm portions 68 and leg portions 70 of each cover section 66 may be cut separately and attached by stitching to a torso portion 72, with an adhesive also being used to produce a seam through which pellets 18 can escape. In either case, the two cover sections 66 are placed together in alignment and are then stitched together with a stitching line 74 extending along their peripheries except for a gap 76 in the top of the body cover 16.

Next, the muslin body cover 16 is turned inside-out by being pulled through the gap 76, causing the peripheral seam 78 where the cover sections 66 are joined by the stitching line 74 to turn inward, as show in FIG. 3. Then, the muslin body cover 16 is filled with the pellets 18, which have been previously treated through the application of fragrant oil.

Referring again to FIG. 1, after the muslin body cover 16 is filled with pellets 18, lines of stitches 26 are sewn at the ankles 28, knees 30, and wrists 32 to block the flow of beads and to provide for articulation of the doll 12.

Referring additionally to FIG. 4, the head portion 36 is prepared by sewing the muslin head cover 40 to extend over the core 38, with a line of stitching (not shown) closing a seam (also not shown) extending along the top surface 54 and back surface 56 of the head portion 36. Various external details, such as the eyes 80, in the form of spherical or faceted black beads, and hair 82 may be applied to the muslin head cover 40 before or after this cover 40 is sewn to be held over the core 38. Other details, such as the eyebrows 83 and lip color 84 may be printed or painted on the muslin head cover 40 either before or after the cover 40 is sewn to be held over the core 38.

The stick 42 is inserted to extend within the slot 42 in the core 38, and the head portion 36 is brought into position atop the muslin body cover 16, with the stick extending downward among the pellets within the torso portion 20 of the doll body 10. Then, the lower portion of the muslin head cover 40 is gathered together around the top portion of the muslin body cover 16 and around the stick 42, and is sewn to the body cover 16 with one or more stitch lines 58. This process forms the neck 59, while producing folds 60, 64, 66 to emulate the wrinkles in the skin of an aged person.

Referring additionally to FIG. 2, the hair 82 is simulated, for example, using strips of shredded paper, such as a paper product sold under the name of GLITTERWRAP SHRED by Glitterwrap, Inc. of Rockaway, N.J. In the example of the figures, lengths of shredded paper 84 are wrapped abound cylinders 86 and glued in place to the cylinders 86 and to the muslin head cover 50 to simulate hair worn in rollers.

The pellets 18 are preferably composed of a thermoplastic resin, such as polypropylene. For example, the pellets 18 may be the product sold under the name POLY-PELLETS by the Fairfield Processing Corp. Before filling the doll body 10, the pellets 18 are coated with a fragrant oil. Satisfactory results have been obtained using each of the following types of fragrant oils: Sweet Mulberry, Cinnamon Spice, and While Gardenia from the Endar Corp. of Temecula, Calif.; Vanilla and Peachy Gel Candles Scents from the Delta Corp. of Whittier, Calif.; and Coconut from Love is in the Air of Hialeah, Fla. A lavender blossom fragrance can also be used. Satisfactory results have been achieved by coating 0.5 liter of polypropylene pellets with 5 drops of fragrant oil, by they stirring the resulting mixture, and by then holding the mixture in a closed container for eight hours.

Alternately, the pellets 18 may be provided with a fragrance using one or more of the methods of U.S. Pat. No. 3,567,119, the disclosure of which is incorporated herein by reference. These methods provide for the incorporation of fragrance compounds or oil bouquets into polymeric or natural materials so that the fabricated product possesses the properties imparted by the additive or additives for a long period. The efficiency of incorporating these additives in the materials is improved by the use of surfactants and the effectiveness and duration of the additive or additives in the fabricated product is enhanced by employing antioxidants.

In another alternative, the pellets 18 may be manufactured to emit a fragrance according to one or more of the methods of U.S. Pat. No. 4,095,031, the disclosure of which is incorporated herein by reference, which discloses perfumed composites of ethylene and polar monomer copolymers, such as vinyl acetate and ethyl acrylate. Shaped bodies prepared from such compounds have been known to faithfully retain the fragrance of perfume oil for periods up to a year or more.

In yet another alternative, the pellets 18 may be manufactured according to one or more of the methods described in U.S. Pat. No. 4,950,542, the disclosure of which is incorporated herein by reference, with the pellets being coated, to provide a sustained release of an aroma, with a composition of a homogeneous emulsion of polyurethane and essential oils.

Figure 6:
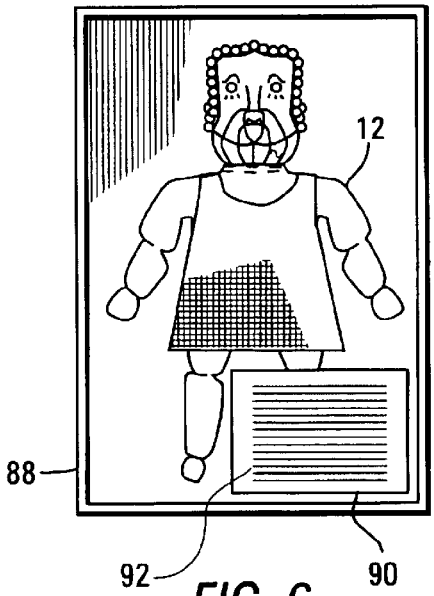
FIG. 6 is a plan view of a packaged product made in accordance with the present invention, including the doll of FIG. 1 and an associated card.

FIG. 6 is a plan view of a packaged product made in accordance with the invention to include the doll 12 and an associated card 90, supplied within a box 88, shown with its top removed to reveal the contents. The associated card 90 preferably includes printed material 92 identifying the doll 12 by name and further describing the value of internal characteristics of a person.

While the invention has been shown in its preferred form or embodiment with some degree of particularity, it is understood that this description has been given only by way of example, and that many changes in the structure and arrangement of parts may be made without departing from the spirit and scope of the invention, as described in the appended claims.

What is claimed is:

1. A doll comprising:

a permeable body covering, wherein said permeable body covering includes a torso portion, a pair of arm portions, a pair of leg portions, and wherein said permeable body covering is sewn to form a closed structure;

an internal structure within said closed structure of said permeable body covering emitting a perfume fragrance through said permeable body covering; and a head portion including a core and a flexible cover stretched over said core, wherein said flexible cover includes a lower portion stretched and gathered together to form a narrowed neck attached to said torso portion, and wherein said flexible cover includes external folds emulating an appearance of an aged person including folds formed within said lower portion of said flexible cover.

2. The doll of claim 1, wherein said core includes contoured features forming features in said flexible cover emulating facial features of a person as said flexible cover is pulled over said core, and said external folds emulating an appearance of an aged person include folds in said flexible cover extending from said facial features.

3. The doll of claim 1, additionally comprising an elongated member extending through said narrowed neck between said core and said torso portion.

4. The doll of claim 3, wherein said internal structure comprises a plurality of pellets stuffing and shaping said body covering, and said pellets are coated with a fragrant oil.

5. The doll of claim 3, 4 wherein said pellets are composed of polypropylene.

6. The doll of claim 1, wherein said permeable body covering is composed of a cloth material.

7. A doll comprising:

a stuffed body portion including a torso portion, a pair of arm portions, and a pair of leg portions, and a head portion including a core and a flexible cover stretched over said core, wherein said flexible cover includes a lower portion stretched and gathered together to form a narrowed neck attached to said torso portion, wherein said core includes contoured features forming features in said flexible cover emulating facial features of a person as said flexible cover is pulled over said core, wherein said flexible cover includes folds extending from said features in said core, and wherein said lower portion includes folds formed to emulate external features of an aged person.

8. A packaged product comprising a doll including a permeable body covering having a torso portion, a pair of arm portions, and a pair of leg portions, an internal structure within said body covering emitting a perfume fragrance through said permeable body covering, wherein said permeable body covering is sewn to form a closed structure around said internal structure, and a head portion including a core and a flexible cover stretched over said core, wherein said flexible cover includes a lower portion stretched and gathered together to form a narrowed neck attached to said torso portion, and wherein said flexible cover includes external folds emulating an appearance of an aged person including folds formed within said lower portion of said flexible cover; and a card including printed material identifying said doll by name.

9. The doll of claim 8, wherein said permeable body covering is composed of a cloth material.

10. The doll of claim 8, wherein said internal structure comprises a plurality of pellets stuffing and shaping said body covering, and said pellets are coated with a fragrant oil.

11. The doll of claim 10, wherein said pellets are composed of polypropylene.

12. The doll of claim 8, wherein said core includes contoured features forming features in said flexible cover emulating facial features of a person as said flexible cover is pulled over said core, and said external folds emulating an appearance of an aged person include folds in said flexible cover extending from said facial features.

13. The doll of claim 8, additionally comprising an elongated member extending through said narrowed neck between said core and said torso portion.

* * * * *